US007785032B2

(12) United States Patent
Segal

(10) Patent No.: US 7,785,032 B2
(45) Date of Patent: Aug. 31, 2010

(54) ARRESTING MOTION OF A VEHICLE HAVING WHEELS WITH TIRES

(76) Inventor: Iftach Segal, P.O. Box 1009, Afula Illit (IL) 18110

( * ) Notice: Subject to any disclaimer, the term of this patent is extended or adjusted under 35 U.S.C. 154(b) by 7 days.

(21) Appl. No.: 12/389,796

(22) Filed: Feb. 20, 2009

(65) Prior Publication Data

US 2009/0263190 A1 Oct. 22, 2009

Related U.S. Application Data

(63) Continuation of application No. PCT/IL2007/001053, filed on Aug. 23, 2007.

(30) Foreign Application Priority Data

Aug. 29, 2006 (IL) ..... 177763

(51) Int. Cl.
*E01F 13/12* (2006.01)

(52) U.S. Cl. ..... 404/6

(58) Field of Classification Search .... 404/6; *E01F 13/12*

See application file for complete search history.

(56) References Cited

U.S. PATENT DOCUMENTS 3,407,550 A * 10/1968 Shaw ..... 52/101
3,456,920 A * 7/1969 Elvington ..... 256/1
3,652,059 A * 3/1972 Groblebe ..... 256/1
4,382,714 A * 5/1983 Hutchison ..... 404/6
4,404,778 A * 9/1983 Ushimaru ..... 52/101
4,544,303 A 10/1985 Glasmire
5,062,612 A * 11/1991 Mincher ..... 256/11
5,322,385 A 6/1994 Reisman
5,328,292 A 7/1994 Williams
5,451,239 A 9/1995 Sewell et al.
5,498,102 A 3/1996 Bissell
5,691,032 A * 11/1997 Trueblood et al. ..... 428/136
5,775,832 A 7/1998 Kilgrow et al.
6,155,745 A 12/2000 Groen et al.
6,206,608 B1 * 3/2001 Blevins ..... 404/6
6,220,781 B1 4/2001 Miller
6,322,285 B1 * 11/2001 Ben ..... 404/6
6,409,420 B1 * 6/2002 Horton et al. ..... 404/6

* cited by examiner

*Primary Examiner*—Gary S Hartmnn
(74) *Attorney, Agent, or Firm*—Cohen Pontani Lieberman & Pavane LLP

(57) ABSTRACT

A barrier (B) for arresting motion of a vehicle driven in an incoming direction (V) and having wheels (18) with tires that couple to fasteners (20) retained in a substrate (10). The substrate has a thickness (T) and is disposed on the ground (G). The fasteners are single-piece fasteners configured for self-retention into the substrate thickness and into a wheel driven over a fastener. A fastener may be configured for engagement via the top surface (14) of the substrate or via the bottom surface (16) of the substrate which has a base (31) with at least one prong (30) or a base (31) with at least one prong and at least one hook (35). The substrate is either a three-dimensional woven web of loops, or a full, or a foamed substrate. The fasteners are introduced into and may be retrieved out of the substrate either manually or mechanically.

20 Claims, 6 Drawing Sheets

ARRESTING MOTION OF A VEHICLE HAVING WHEELS WITH TIRES

RELATED APPLICATIONS

This application is a Continuation Application of International Application No. PCT/IL2007/001053 filed on 23 Aug. 2007. This application claims priority from Israeli application no. 177763 filed Aug. 29, 2009, the entire content of which is hereby incorporated by reference.

FIELD OF THE INVENTION

The present invention relates to vehicles having wheels with tires, and in particular to a device, a system, and a method for fully arresting a wheeled vehicle refusing to stop.

BACKGROUND OF THE INVENTION

The problem related to the stopping of a fugitive vehicle is well known to law enforcement and to military forces. One solution such as a portable barricade often fails when a vehicle crashes through the barricade and escapes. Alternatively, even two or more police cars parked across the road to form a roadblock hardly provide satisfactory results.

To at least slow down a fleeing vehicle, various systems have been proposed, such as for example barriers configured to puncture the tires of a vehicle refusing to stop. One common type of such a barrier is a lightweight latticework, laid across the road and carrying a number of tubular upright-standing spikes. When a fugitive vehicle is driven over the barrier, some of the spikes penetrate the tires that deflate. The damage caused to the tires significantly retards the vehicle making it hard to control, but does not necessarily stop the vehicle, which may continue "on the rims" for a further considerable distance.

European Patent Application No. 0 280 076 A1 to Dörfliger, recites a street barrier having a flexible belt carrying rigid plates, where each plate supports two perpendicular spikes. Each rigid plate is built as an upper plate and a bottom plate that are assembled on both sides of the belt. An assembly of parts is provided to attach to each spike with a screw to the rigid plate and to the belt.

U.S. Pat. No. 6,322,285 to Ben, recites a removable vehicle barrier for stopping a moving vehicle. The barrier includes a high tensile strength filament disposed transverse to the direction of vehicle movement, having spaced-apart tire adhesion elements attached to the filament. The adhesion elements are provided with lower spike plates for attaching themselves to the tires of the moving vehicle when the vehicle passes over the barrier, thereby winding the filament around the component of the vehicle underside, and effecting the halting of the vehicle. The lower spike plates are covered to allow passage thereover by a vehicle front wheel without engaging the filament, front wheel passage causing exposure of the lower spike plates which then attach themselves to the rear wheels of the vehicles.

Canadian Patent No. 2 393 380 A1 recites a vehicle disabling device wherein a plurality of holding spikes like probes with base plates strung on to a cable of wire rope with ends fashioned into a running bowline or noose to chock and hold vehicles tires.

The International Patent Application No. WO 2004/072382 to Lyddon et al. recites a net that is laid flat on the ground and disposed across the path of an incoming vehicle to be arrested. Two rows of barbed spikes are attached to the net along its leading edge, so that when a vehicle runs over the net, the spikes lodge into its front tires. Thereafter, the net wraps around the front wheels until it is pulled tight under the vehicle: The tension created in the net prevents further rotation of the wheels, and brings the vehicle to a stop.

However inherently to its nature, the net allows spikes to be attached only to the knots connecting the meshes of the net, and nowhere else on the net. Furthermore, attaching a spike to a knot is laborious, labor intensive and time consuming. Moreover, a single spike presents stability problems such as toppling-over when engaging a wheel. In addition, the strength and resiliency of the net in length and in width is not controllable independently, and certainly, resiliency in compression is not achievable in a third thickness dimension.

U.S. Pat. No. 6,220,781 to Miller, referred to as Miller hereinbelow, recites a vehicle stopping device having a panel of material, which has a tactile leading edge whereon barbed pins extending upwardly therefrom and/or adhesive blisters are disposed. The panel of material is formed of a very lightweight material, such as silk.

Miller does not recite how the leading edge supporting the pins of the panel of silk, which is applied in concertina-folded arrangement onto a roadway, remains applied thereto in a flat condition. Furthermore, Miller does not disclose implementation details about the base portion of the pins, about the fastening of the pins to the panel of silk, and about how toppling over of the pins attached to the lightweight silk panel is prevented.

Miller depicts pins disposed only on the leading edge, which are possibly inserted only through the bottom portion of the panel, and which will leave a hole in the plain panel of silk when retrieved therefrom.

U.S. Pat. No. 4,544,303 to Glasmire, referred to as Glasmire hereinbelow, recites a protective traffic barrier with a rectangular-shaped planar base having wedge-shaped projections which extend perpendicularly upward from the planar base along the longitudinal center line. A barrier having this configuration may be placed across a roadway to prevent entrance of unauthorized vehicular traffic. The wedge-shaped projections cut out of the base top and bent vertically upward may also be protected with a resilient, encapsulating cover to prevent injury to people and animals. The weight of a vehicle on the wedge-shaped projections will puncture the vehicle tire despite the protective cover.

It was remarked hereinabove that tire puncture may retards a vehicle, which may escape and be driven "on the rims" for a further considerable distance.

Glasmire teaches that the barrier may be secured to the road surface using anchor rods or bolts. Hence, it seems that the disclosure of Glasmire refers to a tire-puncturing device, fixedly retained to the road, which device may or may not stop a vehicle.

U.S. Pat. No. 5,775,832 to Kilgrow, referred to as Kilgrow hereinbelow, recites a compact tire deflator comprising a compact housing member having a first panel pivotally disposed in relation to a second opposing panel by means of a pivotal engagement 22. In structure, the housing member comprises an intermediate portion providing an internal surface area being sufficient for housing at least one spike mounting assembly 1 further disposed in pivotal relation to the pivotal engagement. Preferably, the mounting assembly is formed having one or more hollow spikes 20. The spikes are configured to operate as a tire deflator.

Kilgrow thus recites a tire deflator. As remarked hereinabove, that tire deflector may retard but not stop a vehicle, which may escape and continue to be driven "on the rims" for a further considerable distance.

It would thus be advantageous to provide a system simple to assemble, and a method for implementing an inexpensive device for repetitive use, allowing to quickly and safely stop a not-complying vehicle refusing to halt. Preferably, the system would have only two types of components, namely a substrate and fasteners disposed thereon.

SUMMARY OF THE INVENTION

One object of the invention is to provide an inexpensive and lightweight vehicle-arrest barrier that is easy and simple to assemble, having a substrate supporting stable fasteners for coupling anywhere to the substrate, at any time, in any desired number and quantity, and configured for effective engagement and self-retention to the tired wheels of a vehicle.

This object can be met by providing an appropriately selected substrate such as for example a three-dimensionally woven mat studded with fasteners that are self-retained in the interior of the thickness of the mat. Each fastener is configured for enhanced engagement and secure self-retention to a wheel, with a plurality of prongs oriented and stabilized by a base and by the thickness of the substrate, for effective operation.

It is another object of the present invention to provide a barrier and a system implementing a method for arresting a vehicle having wheels with tires. The barrier, the system and the method comprise a substrate disposed on the ground and having a substrate width oriented along the incoming direction and a substrate length in perpendicular thereto, and a plurality of fasteners retained to the substrate. In accordance with an embodiment of the invention, the substrate is configured as a three-dimensional ground-conformable structure having a substrate thickness forming a substrate height separating between a substrate top surface and a substrate bottom surface which is disposed on the ground, and a plurality of fasteners is provided that is configured for self-retention into a wheel and into the substrate thickness when inserted therein via at least one of both the substrate bottom surface and the substrate top surface. Thereby a wheel driven over the substrate top surface operatively couples to the substrate.

It is yet another object of the present invention to provide each fastener out of the plurality of fasteners with a specific fastener configuration including a base having at least one prong or a base having at least one prong and at least one hook and wherein the substrate accommodates simultaneous use of different specific fasteners configurations. Furthermore, each fastener is configured for insertion into and for retrieval out of at least one of both the substrate top surface and the substrate bottom surface.

It is another object of the present invention to provide fasteners made as a single-piece fastener, out of a single type of material in a single manufacturing process, or made as a plurality of pieces and out of a plurality of materials.

It is another object of the present invention to provide fasteners configured for reversible insertion into and for reversible retrieval out of the substrate top surface or out of the substrate bottom surface.

It is still another object of the present invention to provide fasteners designated as 20[i, j] having a base, i prongs, and j hooks, with i being a positive integer different from zero, and where j is a positive integer including zero.

It is yet another object of the present invention to provide the substrate and the plurality of fasteners for rapid deployment when the substrate is folded or rolled, and to allow deployment of the substrate to be achieved free of entanglement.

BRIEF DESCRIPTION OF THE DRAWINGS

Preferred embodiments will now be described, by way of non-limiting example only, with reference to the accompanying drawings, in which.

DETAILED DESCRIPTION OF THE DRAWINGS

FIGS. 1, 2*a*, 2*b*, 2*c*, 3, 4, 5*a*, 5*b*, and 6 to 12 referring to various exemplary embodiments are used for the description of a device and a system made according to a method to be used for arresting a vehicle.

Figure 1:
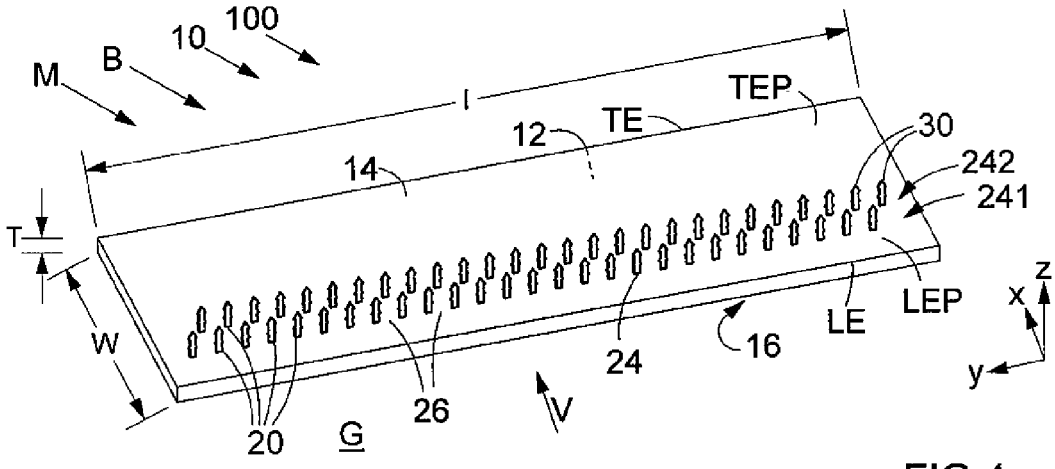
FIG. 1 is a general view of an arrest barrier.

FIG. 1 is a general view of an embodiment 100 showing an example of a barrier B, having a ground-conformable substrate 10 configured as a three-dimensional normal parallelepiped with a length L, a width W and a thickness T, which forms a substrate interior 12 separating between two substrate surfaces, namely a substrate top surface 14 and a substrate bottom surface 16. The bottom surface 16 is intended for disposition on the ground G, and the top surface 14, which is opposite thereto, faces upward toward the sky and away from the ground.

Although depicted as a substantially normal parallelepiped, the substrate 10 is possibly implemented in any desired practical or functional geometrical shape, selected with a thickness T and material density that is even or uneven. This means that the thickness T and the density are not necessarily uniform but that the substrate thickness T and density may be constant or variable as desired.

The dimensions of the substrate 10 are selected as desired by a user. The length L is possibly selected to be about as long as the width of a road, for example typically some 6 m long, or having any another length. The width W may be as wide as at least half the periphery of a wheel 18, not shown in the Figs., or preferably 3 m long, or having any another width. Likewise, the thickness T may range for example from 0.5 mm to 100 mm and have either a uniform thickness or an uneven thickness distribution over the substrate 10.

The term wheel is used hereinbelow in association with a vehicle driven on wheels having tires, for example referring to a pneumatic tire mounted on a wheel rim and forming a wheel assembly, or wheel 18. Retention to a wheel 18 relates to retention to one wheel or to a couple of wheels such as the front wheels of a vehicle for example, and thus means retention to the tire of the wheel(s).

In operation, the length L may be disposed across a road in substantially perpendicular to the incoming direction of a vehicle indicated by the arrow V, which vehicle is not shown in the Figs. The incoming direction is the direction in which the vehicle is driven toward the substrate 10 or the barrier B. When driven over the substrate 10, the wheel 18 will first engage the leading edge LE of the substrate 10, which is a front portion of the leading edge portion LEP, and thereafter the trailing edge portion TEP of the substrate 10, which is terminated by the trailing edge TE.

In a three-dimensional system of coordinates shown in FIG. 1, the x-axis is oriented in the direction taken by an incoming vehicle that is driven toward and over the substrate 10, thus in the incoming direction of the arrow V. Furthermore, the y-axis is directed in parallel to the length of the substrate 10, thus across the road, and the z-axis indicates the thickness T of the substrate 10.

FIG. 1 also illustrates a plurality of fasteners 20 where each fastener is shown for example as having two prongs 30 engaged in the substrate interior 12 and protruding out and away from the top surface 14. The length of each prong 30 may be either the same or different. The fasteners 20 may be aligned in at least one row 24 of fasteners possibly disposed on the leading edge portion LEP and in parallel to the length L, with an interval 26 between each consecutively disposed fastener 20. Preferably, the fasteners 20 may be disposed on the substrate 10, and retained thereto for example in at least two parallel rows 24 of fasteners, having a first row 241 of fasteners 20 closer to the leading edge LE, and downstream in the direction V, a second row 242 of fasteners 20.

The fasteners 20 of the first row 241 may be distributed in staggered disposition relative to the second row 242 or any other row, where for example the interval 26 is chosen relative to the width of the pneumatic tire of a wheel 18, not shown in FIG. 1. This means that if a wheel 18 is driven over the leading edge LE and manages to pass in between two fasteners 20 on the first row 2411 then the wheel 18 will meet another fastener 20 disposed on the second row 242 since the fasteners 20 of both rows 24 are distributed in relative staggered disposition.

In general, the substrate 10 is configured to accommodate a plurality of identical fasteners 20 or a mix of different fasteners of various types. The fasteners 20 may have one or more prongs 30 and have hooks 35, and may be disposed in a single or more rows, or in any desired quantity, pattern, or distribution over the substrate 10. In other words, fasteners 20 may be disposed for example both on the leading edge portion LEP and on the trailing edge portion TEP of the substrate 10, or anywhere else on the substrate 10, in rows 24, or in any direction, grouping, or pattern. Hooks 35 are described hereinbelow.

All types of fasteners 20 are always configured for engagement to the substrate 10 and to the wheels 18.

When a vehicle driven in the incoming direction V runs over the substrate 10, the fasteners 20 will couple to the wheels 18, thus engage and firmly lodge into its tires. Following this fastening to the wheels 18, the substrate 10, which is retained to the fasteners 20 will wrap around the wheels 18, and will thereafter entangle with the understructure of the vehicle until pulled tight between the two wheels 18, which are then forced to stop their revolution and thereby arrest the vehicle. In other words, there is described a method for implementing a barrier and a system for arresting a vehicle driven in an incoming direction V, and having wheels 18 with tires that couple to the fasteners 20 retained in a substrate 10. The substrate 10 has a substrate width W that is disposed along the incoming direction and a substrate length L in perpendicular thereto, thus across the path of the incoming vehicle. First, it is requested to provide the substrate 10 with a substrate thickness T, which forms a substrate height separating between a substrate upper surface 14 and a substrate bottom surface 16 which is disposed on the ground G. Next, there is need to provide a plurality of fasteners 20, say single-piece fasteners configured for self-retention into the substrate thickness T and into a wheel driven over a fastener, and whereby a wheel 18 driven over the substrate top surface 14 and over at least one fastener 20 out of the plurality of fasteners operatively couples with the at least one fastener and thereby also with the substrate.

The substrate 10 needs to be resilient in stretch at least along the substrate length L, but preferably both the substrate length L and the substrate width W are resilient in stretch, and the substrate thickness T is resilient in compression.

If the fasteners 20 disposed on the leading edge portion LEP do not couple to the front wheels 18 of a vehicle, then the rear wheels will become engaged. For purposes of redundancy, it is possible to dispose fasteners 20 on the trailing edge portion TEP or anywhere else on the substrate 10, in the aim to engage the front wheels 18, or the rear wheels.

Should it be desired to provide a bi-directional arrest barrier B when using unidirectional fasteners 20 then the fasteners may be disposed in two separate sets, as follows. A first set of fasteners 20 is disposed on the leading edge portion LEP of the substrate 10 so as to face to face a vehicle arriving in the incoming direction V. Then, a second set of fasteners 20 is disposed on the trailing edge portion TEP of the substrate 10, to engage a vehicle arriving in the direction opposite to the incoming direction V. Thereby the leading edge LE and the trailing edge TE are defined according to the incoming direction V of the vehicle. Evidently, the fasteners 20 may be disposed to respond to any combination of possible directions of arrival of a vehicle, and multidirectional fasteners may be used.

The substrate 10 and the fasteners 20 are configured to provide a safe arrest without directional deviation of the vehicle, without shocks and without endangering the safety of the occupants of the vehicle.

FIGS. 2*a*, 2*b*, 2*c*, 3, 4, 5*a*, 5*b*, 7 and 8 depict various embodiments of fasteners 20 having at least one prong 30 and a base 31, and possibly at least one hook 35. The numerals 20, 30, and 31 are a general designation for, respectively, a typical fastener, a typical prong, and a typical base.

The numerals 201, 202*a*, 202*b*, 202*c*, 203, 204, 205*a* and 205*b* designate specific exemplary embodiments of fasteners 20 configured for engagement via the bottom surface 16. Likewise, the numerals 205, 206, and 207 designate specific exemplary embodiments of fasteners 20 for engagement via the top surface 14. Typically, each fastener 20 has a number of prongs 30 ranging from at least one prong and up to m prongs, where m is a positive integer different from zero.

Figure 2A:
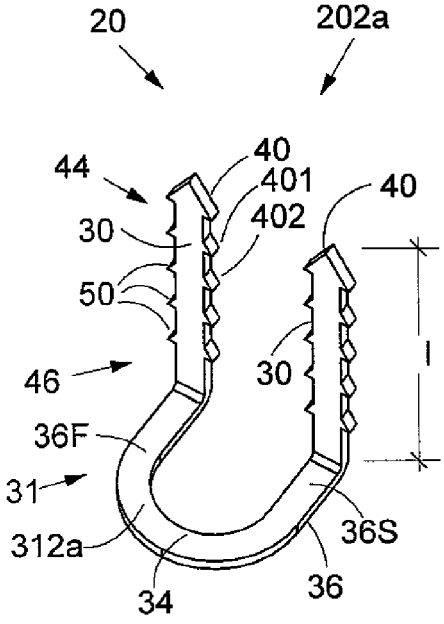
FIGS. 2*a*, 2*b*, and 2*c* show fastener embodiments having two prongs.
Figure 2B:
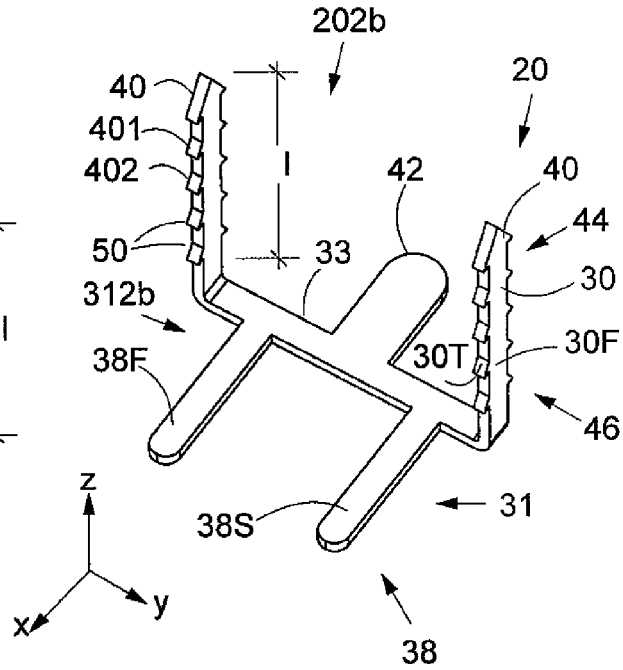
Figure 2C:
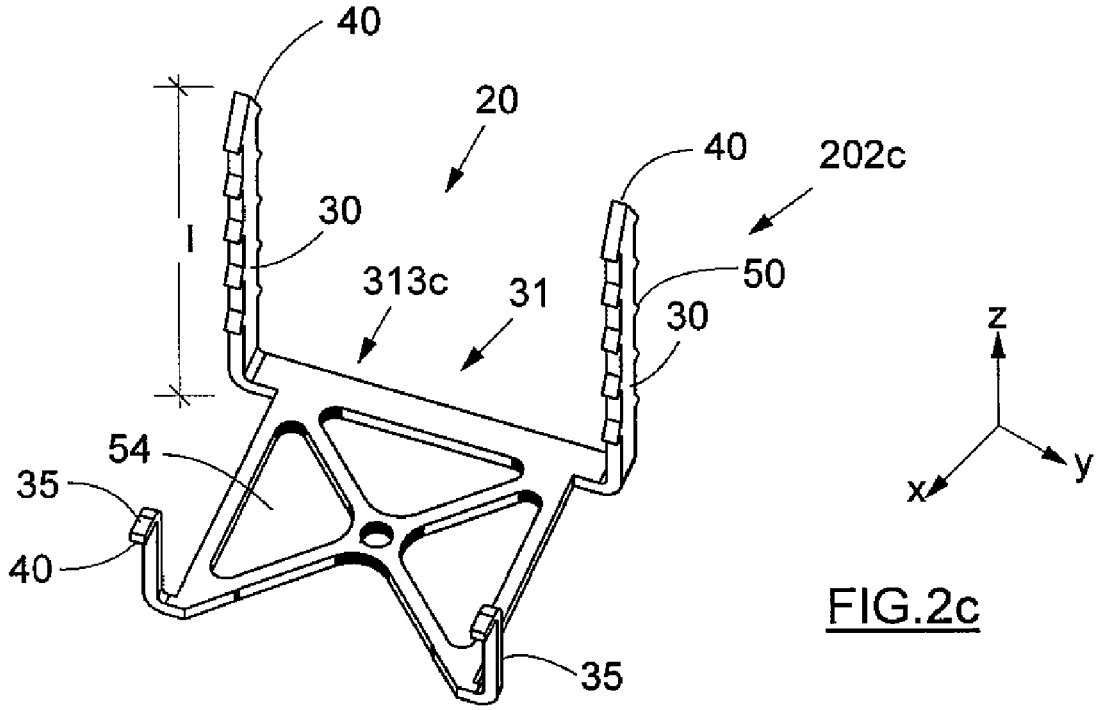

FIG. 2*a*, FIGS. 2*b*, and 2*c* show different embodiments, respectively 202*a*, 202*b*, and 202*c* as examples of fasteners for engagement via the bottom surface 16, all having two prongs 30 and a base 31.

In FIG. 2*a* the base 31 of the embodiment 202*a* is marked as 312*a* and is configured in the form of the capital letter U, but alternatively, any base 31, and also the base 312 may be shaped as desired, for example in the form of the capital letter V, or of the Greek letter omega, or of a horseshoe, or in any other open, hollow, or closed shape. A base 31 is configured according to support provided by the ground G and in view of weight considerations.

The configuration of a typical base 31, and also of the base 312*a*, may be either symmetrical as shown in FIG. 2*a*, or asymmetrical even though not shown as such in the Figs. A symmetric base 31 and the curved portion 34 may have two symmetrical arms 36 of the same length, but may include an asymmetrical configuration where the curved portion 34 is not symmetric and/or a first arm 36F and a second arm 36S have a different length.

For example, a fastener 20 with two prongs 30 and with two arms 36F and 36S of different length may be coupled to the leading edge portion LEP of the substrate 10, and have a base 31 with a base configuration 312*a* disposed downstream of the prongs which face the incoming vehicle. In this case, the wheel 18 will first engage the prong 30 closer to the leading edge LE, and then the second prong 30 disposed farther away from the leading edge LE. Both prongs 30 may have the same prong length l or a different prong length. If desired, a prong 30 having a shorter prong length l is attached to the shorter arm, say 36F, and a prong 30 having a longer prong length is attached to the longer arm 36S, or vice versa.

The base configuration 312*a*, like all the bases 311, 312*b*, 312*c*, 313, and 31*m*, is intended to rest on the ground G. A base 31 disposed on the ground G and the thickness T of the substrate 10, respectively stabilize and provide a direction of orientation to the prongs 30 of each fastener out of the plurality of fasteners, in the generally upward direction pointing away from the ground.

A fastener 20 may thus always be configured to comprise at least one prong 30 and a base 31, and is accommodated for reversible insertion into and for reversible retrieval out of the bottom surface 16, but may also be configured for reversible insertion into and for reversible retrieval out of the top surface 14 as described hereinbelow. A fastener 20 is configured for insertion into the substrate 10 and may be inserted therein either in any selected orientation or in an orientation relative to the incoming direction V of the vehicle or otherwise. Furthermore, a fastener 20 may be configured to be either a symmetric fastener or an asymmetric fastener, relative to the configuration selected of the base 31 and for the prong(s) 30.

When inserted into the substrate interior 12 prongs 30 first, each fastener 20 configured for engagement via the bottom surface 16, such as the embodiment 202*a*, 202*b*, 202*c*, 203, 204, 205*a* and 205*b*, may penetrate until the base 31, here specifically 312*a* for the embodiment 202*a*, abuts with the bottom surface 16 and prevents further penetration therein. The insertion of a fastener 20 is possibly achieved simply by mere manual tool-less operation, or if desired, by automatic means, or by a combination of manual and automatic means.

With the fastener embodiments 202*a*, 202*b*, and 202*c*, just like in all the other various exemplary fastener embodiments 201, 203, 204, 205*a*, 205*b*, 206 and 207, each prong 30 has a prong free-end portion 44, or free portion 44, and a prong retained-end portion 46, or retained portion 46. Each prong free portion 44 may terminate in a tip 40, and each retained portion 46 couples the prong 30 to the base 31. The tip 40 of the prong 30 may be configured as a symmetric arrowhead having an arrowhead 401 and an arrowhead undercut 402, or as an asymmetric arrowhead, which is not shown in the Figs.

With all the exemplary embodiments of the fasteners 20, as well as with the embodiments 202*a*, 202*b*, and 202*c*, the prongs 30 are preferably covered with barbs 50 extending over both the prong free portion 44 and the prong retained portion 46, thus over all the length of the prong 30. The barbs 50 may be configured for secure self-retention to the wheels 18 and to the substrate interior 12, so as to prevent exit of a fastener 20 out of substrate 10. Optionally, only a portion of the prong 30 is covered with barbs 50, which are disposed on the prong free portion 44 adjacent the tip 40 of the prong 30. Likewise, if desired, only a portion of the free portion 44 and a portion of the retained portion 46 disposed adjacent the base 31, are covered with barbs 50. However, the barbs 50 of the free portion 44 and on the retained portion 46 may have a different configuration, such as a different size and pitch. It is noted that only the tip 40 of the prong 30, without any barb 50, may suffice for secure engagement with a wheel 18, and that only a single barb 50 on the retained portion 46 may suffice for secure retention to the substrate 10.

In all the various bottom surface fastener embodiments 201, 203, 204, 205*a*, 206 and 207, the barbs 50 disposed on the free portion 44 may be intended for coupling the fastener 20 in self-retention to a wheel 18, whereas the barbs 50 disposed on the retained portion 46 may be intended for the self-retention of the fastener 20 into the thickness T of the substrate 10. However, the barbs 50 disposed on the free portion 44 may be configured for self-retention to both a wheel 18 and to the substrate 10. If desired, the barbs for self-retention to a wheel 18 and the barbs for self-retention to the substrate 10 may be the same or have a different configuration. Likewise, in all the various embodiments of a fastener 20, the prongs 30 may have the same or a different prong length l, in addition of having the same or a different configuration.

Still with all the various configurations of fasteners 20 shown as embodiments 201, 202*a*, 202*b*, 202*c*, 203, 204, 205*a*, 205*b*, 206 and 207, the prongs 30 may be typically disposed in mutual substantially parallel alignment and substantially in perpendicular to the base 31. In such a typical configuration, the fastener 20 becomes a multidirectional device. Prongs 30 that are slanted toward an incoming wheel 18 are better suited as unidirectional fasteners. In general, any prong 30 out of the prongs of a fastener 20 may be oriented in any desired direction relative to the base 31. A fastener 20 may thus be configured as a multidirectional fastener or as a unidirectional fastener. This means that when engaged in a substrate 10, that is disposed on the ground G in the path of an incoming vehicle, a multidirectional fastener 20 will engage a wheel 18 that is driven thereover and become retained to the tire whatever the incoming direction V of the wheel 18.

However, the retention of a fastener 20 to a wheel 18 may be enhanced by slightly opening the angle between prongs 30 relative to the base 31, say to some 95° or 105° for example, and by directing the prongs 30 toward the incoming vehicle. This means that an incoming wheel 18 will first be driven over the prongs 30 that are slightly inclined toward the wheel 18 to first engage the tire, and thereafter be driven over the trailing base 31. In other words, the inclined prongs are disposed upstream and the base 31 trails downstream.

Likewise, the two prongs 30 may mutually slant relative to each other to form an angle of say 10° or 15°, so that the prongs 30 may be oriented to converge at a distance away from the base 31 or to diverge. This means that the prongs 30 may be disposed to form a mutual spatial angle relative to each other. The purpose of selecting spatial angles between the prongs 30 is to possibly even further enhance the self-retention of a prong 30 to both a wheel 18 and to the substrate 10.

A fastener 20 may be viewed as a flat-shaped blank of material having a base 31 that is coupled to one or more prongs 30, which are appropriately folded to become substantially perpendicular to the base 31, or slightly out of perpendicular thereto, thereby forming an operational fastener 20. The base 31 of a fastener 20 may be configured in the shape of the letter V, or of the Greek letter omega, or as a horseshoe, or as a question mark, or as the letter L, or in any other open, closed, or hollow shape. It is noted that the V-shape, the U-shape with non-parallel arms, and other shapes not shown in the Figs., may permit nesting and thereby offer savings of material in production.

With the fastener embodiment 202*a*, the base 312*a* may also be viewed as a flat shaped U having a base curved portion 34 and two prongs 30, which may be appropriately folded to form a desired angle relative to the base 312*a*.

In FIG. 2*b* the preferred embodiment 202*b* is shown with the base 31 configured in the form of a base bar 33 connecting between the two prongs 30, and having two legs 38 extending away therefrom. A tongue 42 is also a portion of the base 31 and extends out of the base bar 33 in the direction opposite to that of the legs 38. The base bar 33, the two legs 38, and the tongue 42 enlarge the footprint of the base 31 that rests on the ground G, and may be implemented with any embodiment of the fastener 20.

Although the base bar 33 is shown in FIG. 2*b* as being symmetrical by having two legs 38 of the same length, a first leg 38F and a second leg 38S may have a different length. Both prongs 30 may have the same length or a different length. The base 33 and the thickness T orient and stabilize the prongs 30. The base 31 may thus be configured to stabilize the prongs 30 when driven-over by a wheel 18. The base 312*b* may be configured in any desired shape, say of a letter E, or any other open, or closed, or hollow shape.

In all the various fastener embodiments, each fastener 20 is preferably produced as a single piece of material but more than one material is an option. If desired, a fastener 20 is stamped out of a sheet of metal and folded, but other production techniques known to the art may also be applied.

For example, a fastener 20, or specifically the embodiment 202*a*, may be implemented out of stock material such as a rod of metal that is appropriately folded and finished. The rod is possibly cylindrical but may have a cross-section of any other geometrical shape. When a prong 30 is cylindrical, the tip 40 and the barb(s) 50 are possibly, respectively conical and frusto-conical.

Typically, a fastener 20 may be configured as a single unitary piece made out of one type of material and produced in a single manufacturing process, have a base 31 and at least one prong 30, and be accommodated for secure self-retention in the thickness T of the substrate 10 and into a wheel 18. However, a fastener 20 may also be configured as an assembly of parts and made out of a plurality of materials, including alone and in combination, plastic material(s), metal(s), and both plastic(s) and metal(s).

In FIG. 2*b*, with reference to the embodiment 202*b*, an incoming wheel 18 may engage the prongs 30 sideways with the thickness 30T of the prong 30 facing toward an incoming wheel 18, and the flat portion 30F of the prong 30 in perpendicular thereto, thereby enhancing the rigidity of the prongs 30 relative the embodiment 202*a* as depicted in FIG. 2*a*.

FIG. 2*c* depicts a preferred embodiment 202*c*, which is implemented according to the principles described hereinabove. The base 31 has a configuration selected to provide a larger footprint for better support on soft ground G, such as gravel for example, but hollow-outs or cutouts 54 may be provided to decrease weight when practical. Each base 31 out of the various described embodiments is configured as desired to match the support and the resistance provided by the ground G.

Two prongs 30 are provided, but so are also two hooks 35, which are dedicated solely for self-retention to the substrate 10. The hooks 35 may be regarded as short and curved prongs, or otherwise, a prong 30 and a hook 35 may be related to as a grip element 30/35. A prong 30 may be configured for self-retention to the substrate 10 or to a wheel 18, or to both the substrate 10 and a wheel 18, whereas a hook 35 is dedicated solely for self-retention to the substrate 10.

A hook 35 may be configured like a straight or curved prong 30 with a tip 40 similar or different to that of a prong 30, and with barbs 50, although not shown in FIG. 2*c*. Both the prong 30 and the hook 35 may be either aligned in parallel but pointing toward substantially opposite directions, or may form a spatial angle. Actually, a hook 35 is a prong 30 pointing to a substantially opposite direction relative to the prong 30, but possibly shorter in length than the prong 30. Likewise, the barbs 50 which are disposed on the prong 30, in distribution along a portion or along the whole length of the prong 30, may be dedicated for self-retention to a wheel 18. Similarly, the barbs 50 which may be disposed on the hook 35, in distribution along a portion or along the whole length of the hook 35, are dedicated for self-retention to the substrate 10. Evidently, the barbs 50 may be the same or be different for a prong 30 and for a hook 35.

In practice for example, a fastener embodiment 202*c* having prongs 30 of the same length l or of different length, may be stamped out of spring steel SAE 1090, folded and tempered. When compared to a fastener embodiment having only two prongs 30 and no hooks 35, the embodiment 202*c* may present enhanced stability when driven-over by a vehicle, as well as better self-retention effectiveness, both to a wheel 18 and to the substrate 10.

A fastener 20 is possibly designated as a fastener 20[i, j] where i represents the number of prongs 30, and j refers to the number of hooks 35 of that fastener. The index i is a positive integer different from zero and running from 1 to m, while j is a positive integer progressing from zero to n. This means that a fastener 20 having a base 31 has at least one prong 30 and may also have a hook 35.

Figure 3:
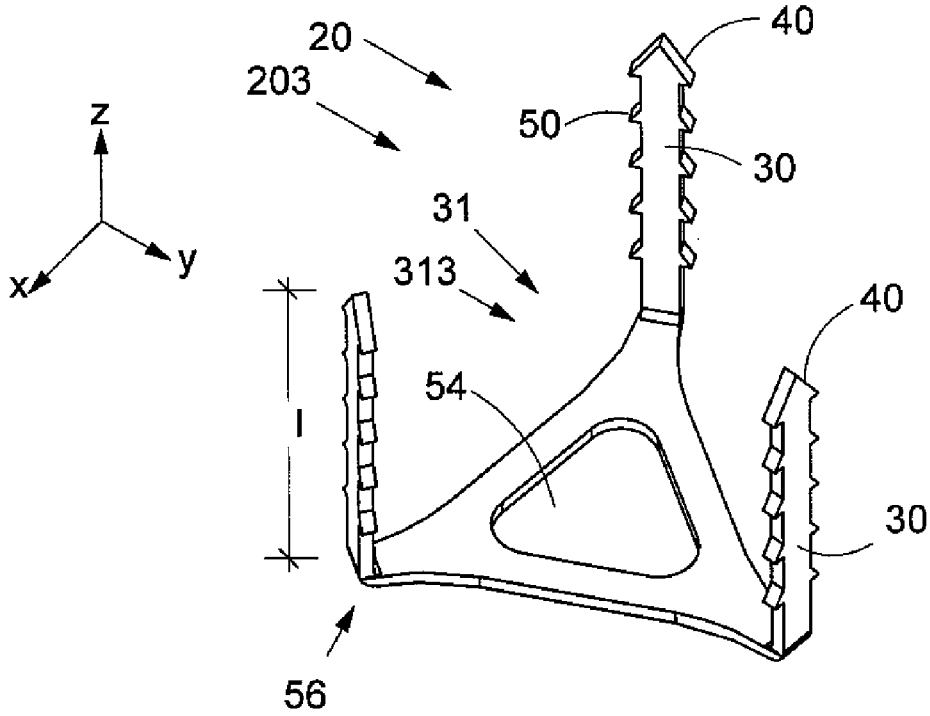
FIG. 3 illustrates a fastener embodiment having three prongs.

FIG. 3 illustrates an example of a fastener 20 for engagement via the bottom surface 16 as an embodiment 203 having three prongs 30 and a base 31 configured as a generally triangular base 311 that is, if desired, hollowed out or provided with a cutout 54. A cutout to decrease weight is possible with any of the bases 31 when practical. A prong 30 extends away from each corner 56 of the triangular base 311. Once again, when compared to a fastener embodiment having only two prongs 30, the embodiment 203 may present enhanced stability when driven-over by a vehicle, as well as better self-retention effectiveness, both to a wheel 18 and to the substrate 10.

As mentioned hereinabove, the fastener embodiment 203 for engagement via the bottom surface 16 may have a base shaped in any desired geometrical shape from which three or more prongs 30 extend. Although the triangular base 311 is shown in FIG. 3 as being symmetrical, and having prongs 30 of the same length, an asymmetric base is feasible and the prongs 30 may be of different length, thus have either the same length l or have a different length.

According to the orientation of the fastener 203, an incoming wheel will first engage one or two prongs 30, and thereafter the other remaining prong(s) 30. The base 31, here with a triangular base configuration 311, which rest on the ground G, and the thickness T of the substrate 10, stabilize and orient the prongs 30 in the generally upward direction pointing away from the ground.

Figure 4:
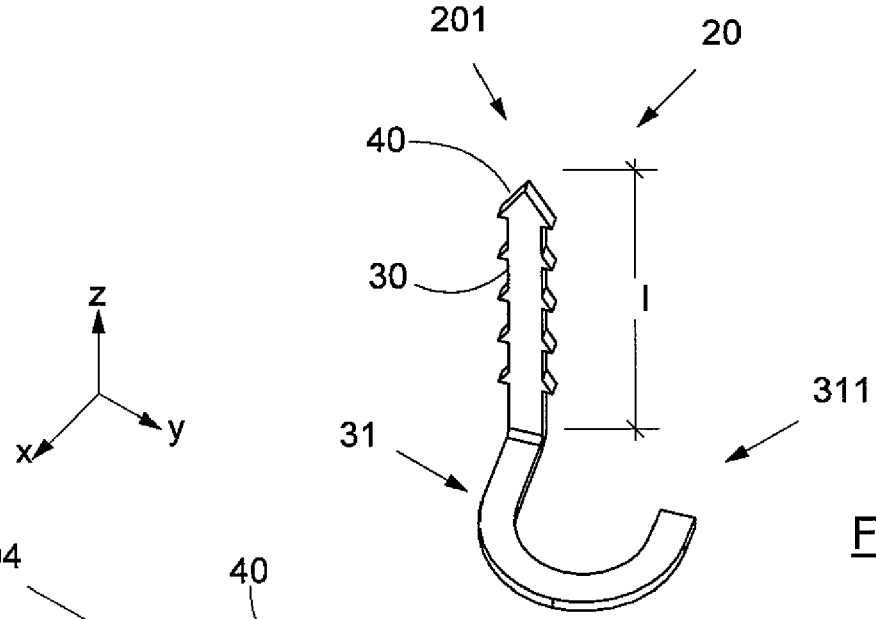
FIG. 4 depicts a fastener embodiment with one prong.

FIG. 4 depicts an exemplary embodiment 201 of a fastener 20 for engagement with the bottom surface 16 having but one single prong 30 and a base 31 configured as a free-ended base 311, in the form of a question mark. The embodiment 201 may be regarded as being an embodiment 202*a* shown in FIG. 2*a* when cut in half. Alternatively, as described hereinabove, other shapes for the base 31 are possible.

Insertion into and retention to the substrate 10, as well as the configuration of the prong 30 and the implementation of the fastener 201 remain the same as described hereinabove for any fastener 20.

Figure 5A:
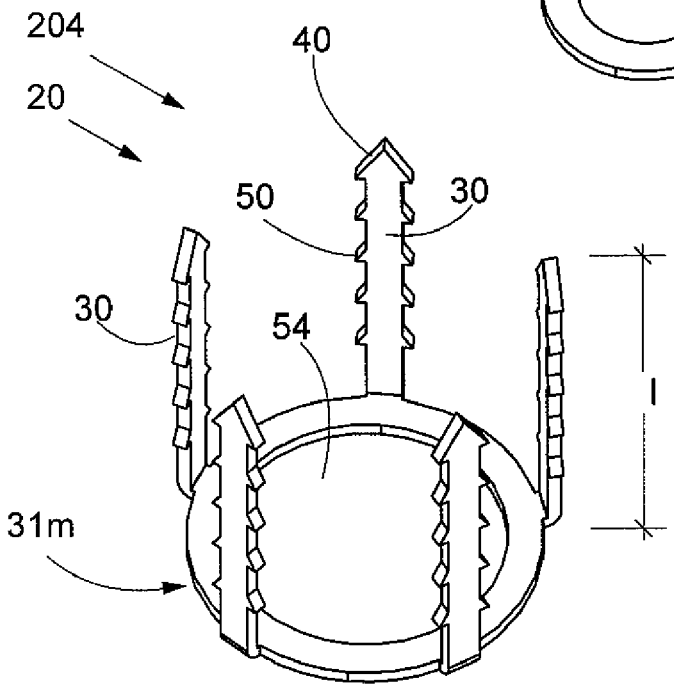
FIGS. 5*a* and 5*b* show a fastener embodiment having i prongs.

FIG. 5*a* shows an exemplary embodiment 204 of a fastener 20 for engagement via the bottom surface 16 with i=5 prongs 30 or more, and a base 31*m* and is depicted as a closed torus, but may be configured as a polygon with a hollow-out, or a cutout 54, or in any other closed or open form. A prong 30 may extend away from anywhere along the periphery of the closed base 31*m*. In practice, when compared to a fastener 20[2, 0]—for engagement with the bottom surface 16 and having two prongs 30—the embodiment 204 may provide enhanced stability when driven-over by a vehicle due to a larger base 31, as well as better self-retention effectiveness, as anticipated when more prongs are available.

The fastener embodiment 204 may also be viewed as having the shape of a sun that is flat-shaped when spread out, with a hollow-out 54 or not, and with a base 31*m* that may be closed, or hollow, or open, from which outward radiating rays, which are the prongs 30, are then folded appropriately to an angle substantially perpendicular to the base 31*m* thereby forming a fastener 20[i, 0].

Figure 5B:
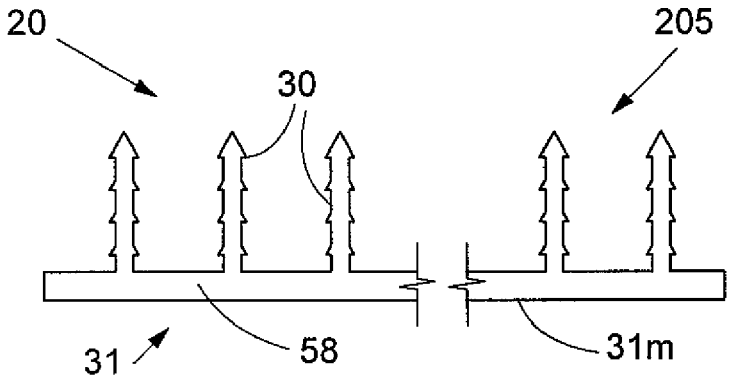

In FIG. 5*b*, a fastener embodiment 205 may be implemented as an endless strip of flat material 58, to be cut to size and folded to form a crown with a base 31. Evidently, the base 31 may be enlarged if desired, by the addition of more footprint surface for ground G contact, such as for example arm(s) 36 and tongue(s) 42.

Figure 6:
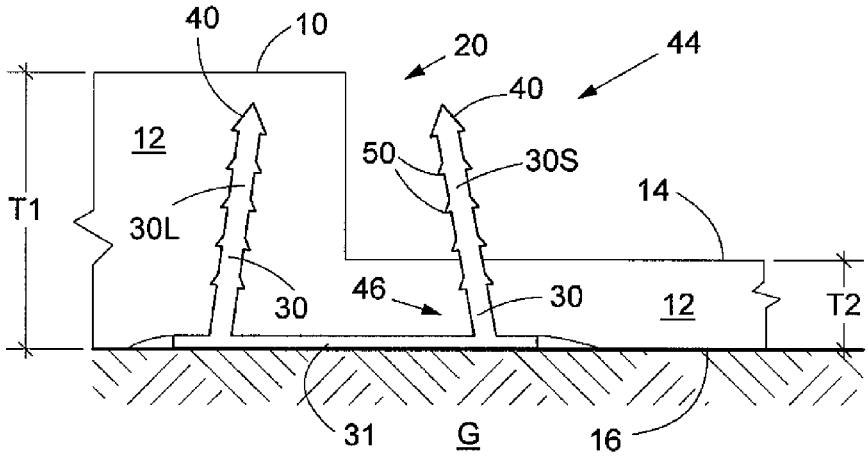
FIG. 6 shows two prongs of different length embedded in a substrate of varying thickness.

FIG. 6 is a cross-section of the substrate 10 showing an example of a fastener 20 with two different prongs 30 inserted therein, which example is valid for all types of fasteners embodiments 20 and of prongs 30. A first longer prong 30L is entirely contained, including the tip 40, within a first thickness T1 of the substrate 10, and a second shorter prong 30S protrudes out and away of a second thickness T2 of the substrate 10. In other words, the entire prong length l of the first prong 30L is confined and hidden within the first substrate thickness T1, but the tip 40 of the second prong 30S protrudes away from the substrate top surface 14.

It is noted that instead of providing a higher thickness T1 and lower thickness T2, it is possible to configure the substrate 10 with a constant thickness T and add a strip of say foamed material to hide prongs 30 pointing out and way of the top surface 14. The thickness T1 may thus be achieved by adding a local or a common piece of material having a height (T1-T2) to a constant thickness T2.

In FIG. 6, the prongs 30L and 30S having different prong length l are shown with a prong base 31 in abutment with the substrate bottom surface 16. Each fastener 20 thus has at least one prong 30 that may either protrudes out and away of the substrate top surface 14 or remain entirely confined within the substrate thickness T when driven therein via the bottom surface 16.

A fastener 20 may thus have at least one prong 30 that is either completely hidden in the interior of the thickness (T) of the substrate or protruding out and away of the top surface. Likewise, although not shown in the Figs., when a fastener 20 has a hook 35, that hook may be hidden in the thickness T of the substrate 10 or protrude thereout. When more hooks 35 are available some hooks may be hidden and others may protrude out and away of the substrate 10.

When a wheel 18 is driven over a confined prong 30, such as prong 30L, the load of the wheel 18 will compress the thickness T1 forcing the prong 30L to protrude out and away of the substrate top surface 14 to engage into the tire of the wheel 18 in secure self-retention.

In FIG. 6 the tip 40 of the second prong 30S protrudes out and away of the second thickness T2 of the substrate 10. In this case, the barbs 50 disposed on the free portion 44 may be optimized only for engagement with a tire of a wheel 18, whereas the barbs 50 disposed on the retained portion 46 of the prong 30 may be optimized only for secure self-retention to the substrate 10. For all prongs 30, it is always possible to provide a barb configuration that is selected as desired: either the same barbs 50 for retention to the substrate 10 or to the wheels 18 along the whole prong length l, or a distribution or a mix of dedicated barbs for retention to the substrate 10 and to the wheels 18. The barbs 50 disposed on the free portion 44 and/or on the retained portion of the prong 30 may thus be all of the same configuration or have a different configuration.

Figure 7:
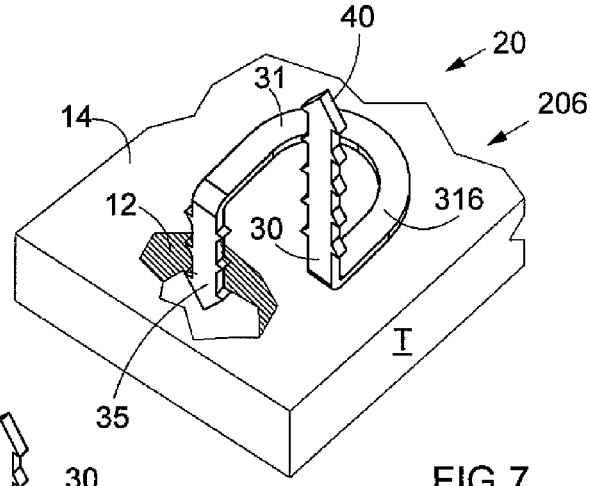
FIGS. 7 and 8 depict a second type of fasteners.
Figure 8:
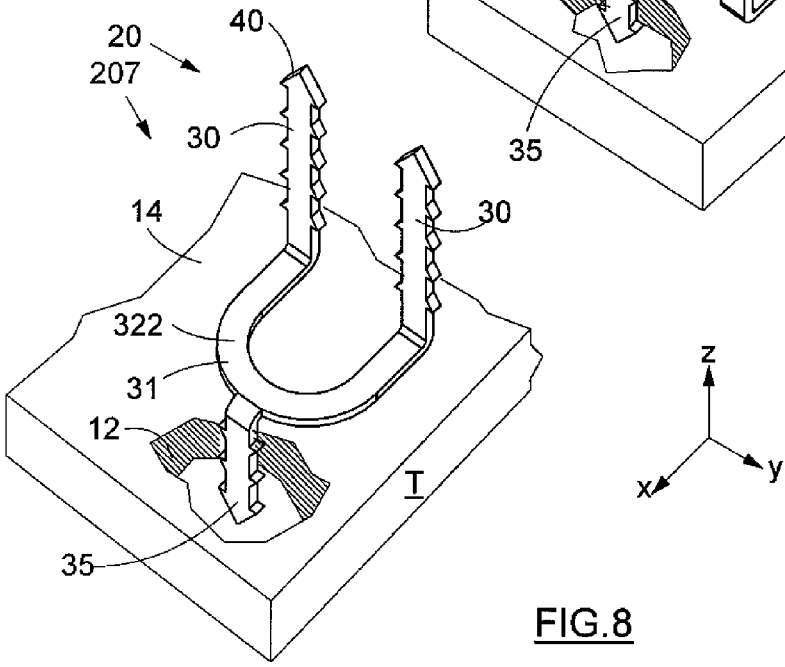

FIGS. 7 and 8 depict exemplary embodiments of a second type of fasteners 20 configured to be engaged via the substrate top surface 14. The first type of fasteners 20 are similar to the second type but for two differences: The second type of fasteners 20 are configured for insertion into and via the top surface 14, and at least one hook 35 is added for self-retention into the thickness T of the substrate 10. In other words: Each embodiment of a second type of fastener 20 for engagement with the top surface 14 may be configured as a unitary piece of material having at least one prong 30, a base 31, and at least one hook 35 configured for insertion via the top surface 14 and for secure self-retention in the substrate thickness T. The second type of fastener 20 may be designated as 20[l, j] where j is at least one.

In the same manner as described hereinabove for a fastener 20 which is configured for insertion via the bottom surface 16, a fastener for insertion via the top surface 14 is configured for reversible insertion into and for reversible retrieval out of the substrate top surface 14.

FIG. 7 illustrates a fastener 20 configured for engagement via the top surface 14 as an exemplary embodiment 206 having one single prong 30, and one single hook 35 coupled to a base 31, here 316, for insertion into the top surface 14, having the form of the capital letter U. The base 31, here a top base 316 may obtain any desired shape as described hereinabove, and one or more prongs 30, as well as and one or more hooks 35 may be coupled thereto. Even though FIG. 7 shows only one single prong 30 and one single hook 35 extending each from the extremity of the top base 316, more prongs 30 and more hooks 35 may also extend anywhere along the periphery of the base. The description provided hereinabove in relation the configuration, shape, size and implementation of the prongs 30, the bases 31, and the hooks 35 applies also with fasteners 20 configured for engagement via the top surface 14.

Each embodiment of a fastener 20 for top surface engagement is configured for penetration, when inserted into the substrate interior 12 hook 35 first, until the base 31, here base 316, abuts with the top surface 14 and prevents further penetration therein. The insertion of a fastener 20 for engagement via a top surface 14 is possibly achieved simply by manual tool-less operation, or if desired, by automatic means, or by a combination of manual and of automatic means.

With fastener for top surface engagement, the prong 30 and the hook 35 are each dedicated for self-retention to, respectively, the tire of a wheel 18 and the substrate 10. When driven over by a vehicle, the thickness T is compressed by the base 31, here 316, flat against the ground G, whereby the hook 35 possibly deforms or is driven into the ground G, while the prong(s) 30 couple(s) to the tire of a wheel 18.

The embodiment 206 of a fastener 20 for engagement via the top surface 14 may have one prong 30 and one hook 35, and is similar to the embodiment 201 of the fastener for engagement via the bottom surface 16 having one prong 30 and to which a hook 35 has been added. Furthermore, the embodiment 206 is also similar to the embodiment 201 of the fastener for bottom surface engagement having two prongs 30, one of which is folded to point in a substantially opposite direction relative to the other one for serving as a hook 35.

FIG. 8 illustrates another exemplary embodiment 207 of a fastener 20 for engagement via the top surface 14 having two prongs 30, and one single hook 35 coupled to a top base 322 in the form of the capital letter U. As already described hereinabove for any base 31, the top base 322 is shaped as desired, for example in the form of the capital letter V, of the Greek letter omega, of a horseshoe, or in any open, hollow, or closed shape.

One or more hooks 35 may be coupled to the top base 322. Even though FIG. 8 shows one single hook 35 extending from the extremity of the top base 322, hooks 35 may also extend anywhere along the periphery of the top base, such as shown in FIG. 2*c* for the embodiment 202*c*.

The embodiment 207 of a fastener 20 for top surface engagement has two prongs 30 and one hook 35 is similar to the embodiment 202*a* to which a hook 35 has been added. Furthermore, the embodiment 207 is also similar to the fastener embodiment 203 having three prongs 30, one of which is folded to point in the substantially opposite direction relative to the other prong 30 and dedicated to serve as a hook 35. Moreover, to form a fastener 20 for top surface engagement having one prong 30 and two hooks 35, it suffices to fold-over two prongs 30 that will serve as hooks 35, so that they will point in the direction substantially opposite relative to the other prong 30.

The numeral 20 is a general indication for a fastener, whereas the numerals 206 and 207 designate specific embodiments of fasteners for engagement via the top surface as described hereinabove. In the same manner, although not shown in the Figs., it is easily feasible to provide fasteners 20 having respectively, i prongs 30 and j hooks 35. The value i is a finite integer ranging from 1 up to any practical number of m prongs 30. Likewise, j is a finite integer ranging from zero up to any practical number n of hooks 35. This means that all the various embodiments of fasteners 20 may be regarded as a fastener 20[i, j], thus having i prongs 30 and j hooks 35, including zero hooks.

A fastener 20 may thus be configured to include a base 31 having at least one prong 30 or a base 31 having at least one prong 30 and at least one hook 35, and such a fastener may be configured for insertion into and for retrieval out of at least the substrate top surface 14 or the substrate bottom surface 16.

Since the shape of a fastener 20 for engagement via the bottom surface 16 and for engagement via the top surface 14 is similar, all the features and details pertaining to the implementation of the prongs 30 and to bases 31 related to the embodiments 201, 202*a*, 202*b*, 202*c*, 203, 204, 205*a*, and 205*b* described hereinabove are applicable to the embodiments 206 to 207, and evidently to the fastener 20[i, j]. Each fastener 20 has one base 31 configured to stabilize the at least one prong 30 when driven-over by a wheel 18, and a base 30 that is configured to stop penetration of the fastener when abutment with a substrate surface is reached, either with the top or the bottom surface, respectively 14 and 16.

Irrespective of the selected type of fastener 20, a fastener is configured to have at least one prong including items such as a tip 40, and at least one barb 50 disposed either on the prong free-end portion 44, or on the prong retained-end portion 46, but possibly on both the free-end portion 44 and the retained-end portion 46. Such a barb on a prong is configured for secure self-retention to either a wheel 18 or to the substrate 10, or to both of them. In contrast, a barb on a hook 35 is configured solely for retention to the substrate 10. A fastener 20 of either type is thus configured to couple with either the wheels 18 of a couple of parallel wheels pertaining to a vehicle having more than two wheels and a wheel of a vehicle having two wheels in tandem.

The three-dimensional substrate 10 is configured for secure retention of the fasteners 20[i, j] coupled thereto in association with the thickness T of the substrate.

Fasteners embodiments 20 having their prongs 30 entirely contained in the substrate interior 12 evidently allow rolling and folding of the substrate 10 without fear that a protruding prong 30 or tip 40 will engage the substrate 10 and prevent fast unrolling or unfolding of the substrate 10 for operative deployment. It is sufficient to provide the substrate 10 with a local thickening of the thickness T, either by thickening of the substrate 10 or by the addition of a pad having an appropriate height, say along two parallel rows 24, or only at the locations where the fasteners 20 may be embedded, while the rest of the substrate 10 may have a lesser thickness. The substrate 10 may be rolled up or folded for stowage, while still permitting fast unrolling or fast unfolding for quick deployment of the barrier B.

The substrate 10 is now described in further details.

The substrate 10 is implemented as a three-dimensional structure or body, which is flexible, elastic, pliable, resilient, and foldable, and has at least a substrate length L that is able sustains large stresses and is resiliently stretchable, and a substrate thickness T that is preferably resilient in compression. If desired, the substrate 10 is configured to feature high tensile strength along all dimensions, thus along the substrate length L, the substrate width W, and the substrate thickness T, as well as a high degree of elasticity and resiliency in stretch and in compression.

The structure of the material from which the substrate 10 is made is selected in response to at least two or three constraints: two necessary constraints applying to the length L and preferably a third constraint related to the thickness T.

The first constraint is the need for the substrate length L to be able to support high tensile strain necessary to prevent shearing forces from developing on the fasteners 20 during their initial fastening phase of operation, which occurs just upon engagement with the tires of the wheels 18. These shearing forces are caused by the pull of the substrate 10 when entangling with the understructure disposed between the wheels 18 of the vehicle. The aim is to prevent excessive shearing forces to be applied on the prong(s) 30 to avoid failure of retention of the fasteners 20 to the wheels 18.

The second constraint concerns the requirement for the substrate length L to be able to support high tensile stresses that develop during the second phase of operation, after the substrate 10 has at least partially wrapped over the wheels 18. During that second phase, the substrate 10 becomes entangled with the undercarriage of the vehicle and huge tensile longitudinal pull forces build up in the substrate 10 disposed between a couple of parallel wheels 18.

The third preferable or optional constraint requires the substrate thickness T of the substrate 10 to have compressible resiliency under the load applied by the wheels 18. When driven-over by a wheel 18, the substrate 10 preferably compresses thereby revealing most of the entire length of the prongs 30 in the case of embodiments 201, 202*a*, 202*b*, 202*c*, 203, 205, 205*a* and 205*b* for fasteners 20 made to be engaged via the bottom surface 16 of the substrate 10.

With the embodiments 206 and 207 for fasteners 20 made for engagement via the top surface 14, having one or more hooks 35, the thickness T of the substrate 10 also compresses when driven-over by a vehicle, for the prongs 30 to firmly engage the tire of a wheel 18 and for the base 31 to rest adjacent the ground G.

Accordingly, the substrate 10 may be appropriately selected as a flexible and pliable three-dimensional weave such as a web woven of high strength material, or as a single or multiple thread spatial structure made of either a single fiber or of multiple fibers. A substrate 10 built or woven in three dimensions is a structure that is in contrast with a twodimensional weave, such as a net, which is woven only in two dimensions and has no loops in height for providing the substrate with a thickness in height. The substrate 10 may be configured as a full, foamed, or meshed material or as a combination thereof, and if desired, may be reinforced by say reinforcement(s) straps in chosen directions. The word "full" is used as an antonym to "meshed", since three-dimensional meshed structures having loops forming open passages to fluids are permeable structures, whereas "full" structures such as a rubber mat or a foamed material mat M for example, may prevent the free passage of fluid and be impermeable structures.

It is noted that with a net, spikes or any other retention devices may be attached only to the knots of the meshes, and not anywhere over the surface of the net.

The substrate 10 may be made entirely from an impermeable homogeneous material and be configured as a flexile, resilient, and pliant three-dimensional mat M, such as a meshed spatial structure or woven mat structure 60, or as a full mat structure 62, which is shown in the FIGS. 7 and 8.

Preferably, the substrate 10 is a flexible and pliable three-dimensional web structure woven out of selected threads, in single fiber or multiple fibers, designed to respond to constraint needs. Nylon threads may be acquired anywhere, for example from Sufix Co., No. 334, Sec. 6, Chang Mei Rd., Homei Chang Hua, in Taiwan, R.O.C. Weaving is possible with textile manufacturers, such as for example Sti. Evoteks Ev ve Otel Tekstili San. ve Tic. Ltd., Beysan Sanayi Sitesi Fuar Cad. No 10, Avcilar 34524 Haramidere, in Istanbul, Turkey.

Figure 9:
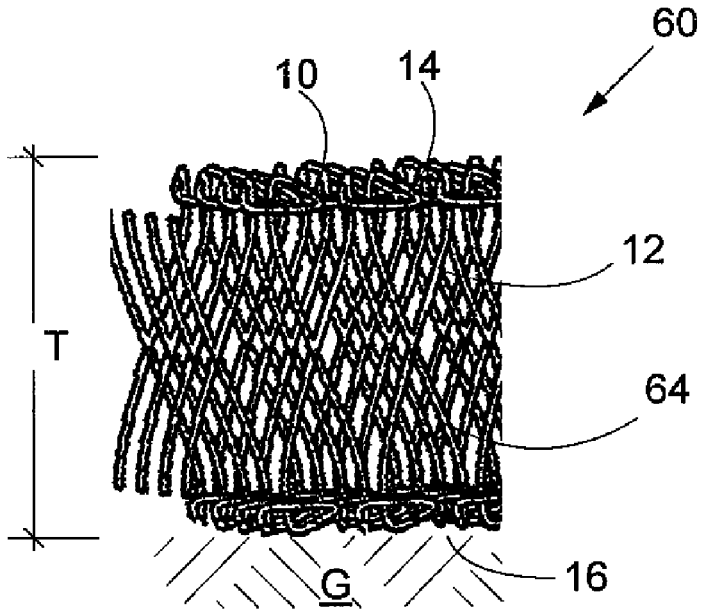
FIGS. 9, 10 and 11 illustrate the structure of a woven mat.
Figure 10:
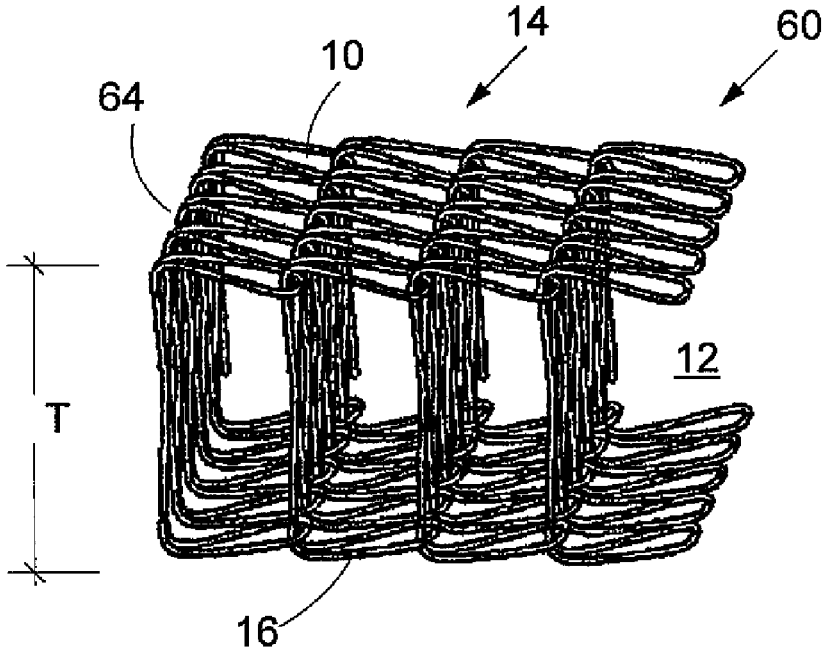
Figure 11:
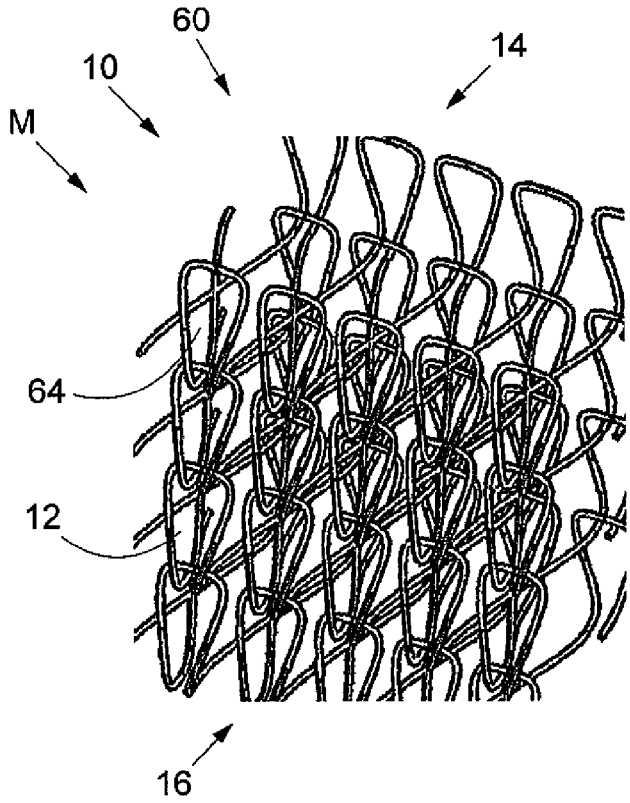

FIGS. 9, 10, and 11 illustrate the structure of the substrate 10 when woven in three dimensions as a plurality of interwoven loops 64 of fiber-formed meshes 64. Such a woven structure 60 may be manufactured out of regular or reinforced material to provide high tensile strength to create an elastically resilient structure, possibly tailored to provide mechanical properties requested along selected directions. For example, the fibers are chosen as natural or synthetic material threads with mono- or multi-filaments, made of say any kind of Nylon, or Nylon 6, or Kevlar, or even metal threads, or of any other appropriate material able to be woven, including a mix of different types of materials and fibers. Nylon and Kevlar are registered Trademarks. Hence, the substrate 10 is made from a material which selected alone and in combination from the group of materials consisting of a natural material and of a synthetic material.

FIG. 9 is a cross-section and FIG. 10 is an isometric view of a three-dimensional woven substrate 60. FIG. 11 is another isometric view of the difficult to visualize three-dimensional woven mat M.

The structure of the substrate 10 is thus a flexible and pliable three-dimensional weave made of a plurality of interwoven loops of fiber connecting between the top surface 14 and the bottom surface 16, and the loops of fiber being woven out of either multi-filaments or mono-filaments, with at least one loop of fibers in height, as shown in FIG. 10. If desired, the substrate 10 is made of a single fiber or of a plurality of fibers, and when made of a plurality of fibers, the fibers are either of the same type of fibers or of a different type of fibers. Furthermore, the substrate 10 may be implemented as a structure that is permeable or impermeable, or semi-permeable, thus partially permeable, if desired.

The substrate interior 12, intermediate to the substrate top surface 14 and the substrate bottom surface 16 shown in FIG. 1, may consist of loops 64 or meshes 64, all inherently compressible. When longitudinal tensile stress is applied to such a woven structure 60, the thickness T thereof diminishes, and the loops separating the substrate top surface 14 and the substrate bottom surface 16 tend to align with the direction of the stress, thereby providing stretchability and elasticity. This means that even should the fibers from which the tree-dimensionally structure 60 be woven only out of inelastic material, stretchability and elasticity would nevertheless be provided inherently by the deformation of the thickness T, thus of the vertical loops 64 that will stretch and tend to align horizontally with the ground G when in longitudinal stress. The thickness T thus provides the ability for the substrate 10 having a woven structure 60 or a full mat structure 62, to stretch.

Independently of the material or structure selected for the implementation of the substrate 10, the volumetric density of the structure may be either uniform over the whole mat M or variable. For example the bottom surface 16 may be denser than the top surface 14, or the volumetric density may decrease from the bottom surface toward the top surface 14. Else, density may be increased at certain locations on the substrate 10, for example where fasteners 20 are planned to be inserted, or as desired.

The substrate 10 may also be provided with numerous kinds of appearance finishes, to be camouflaged or almost unperceivable to a driver when disposed on a road, or on the contrary, to be standing-out and easily seen. For example, an appearance-finish may be selected as consisting of transparent, single color, multicolor, shiny, and matte finish or as any combination thereof.

To achieve a strong, lightweight, flexible, and pliant resilient woven structure 60, a judicious choice of material(s) is made in response to design constraints and requirements.

For additional enhanced longitudinal stress resiliency, the woven mat 60 may be provided with at least one longitudinal slack strap disposed along the length L. If desired, one or more lateral slack straps may be disposed along the width W of the substrate 10, or along any selected direction. The same is true for a full mat 62.

Figure 12:
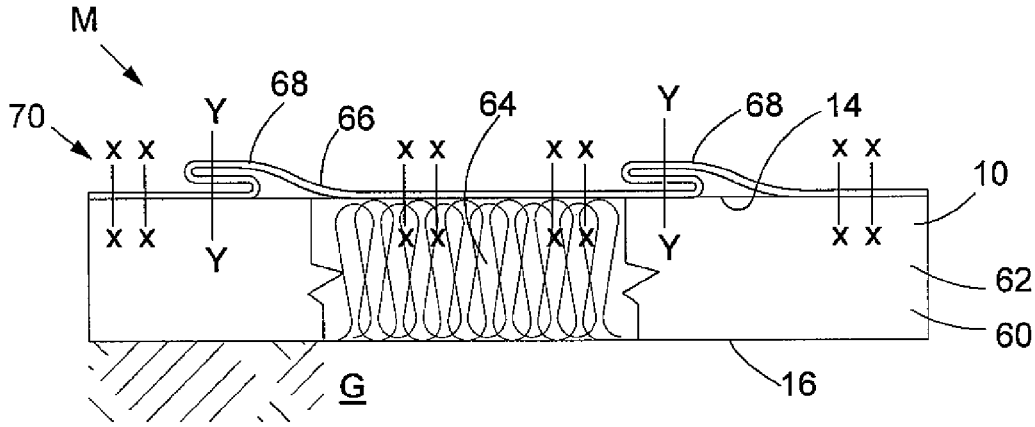
FIG. 12 illustrates a reinforcing strap.

FIG. 12 shows a high-strength strap 66 sewn along the length L of the woven mat 60. The strap 66 is securely retained to the woven mat 60 by sewn stitches marked as X-X, and has slack elements 68 disposed in spaced apart distribution. The slack elements 68 are retained to the woven mat 60 by releasable stitches marked as Y-Y. When the woven mat 60 reaches a predetermined level of stress, the releasable stitches Y-Y retaining the strap 66 to the woven mat 60 will snap and liberate the slack elements 68 to allow further expansion of the woven mat 60. From that moment on, the strap 66 operates in association with the substrate 10 to provide increased tensile strength to the substrate. For example, the sewn stitches X-X, pertaining to a strap 66 may snap when the length L of the substrate 10 reaches and elongation of say 250%. It is noted that the woven mat 60 may be configured to stretch for up to 350% of elongation in length L and in width W. When a plurality of straps 66 is provided, their sewn stitches X-X may snap simultaneously or randomly. The substrate 60 either woven, foamed, or full is thus possibly configured for enhanced stress by the addition of at least one slack strap on which at least one slack element is disposed. The substrate 10 thus has a structure that may be reinforced with at least one reinforcement strap 66.

Since the structure having a thickness T may be woven to have loops, or may be a full structure 62, there is no difficulty to attach fasteners 20 thereto. Any number of prongs 30 is easily introduced in or through the substrate 10 in situ, such as in factory or in the field for example, at any desired location on the substrate, and in any orientation. The barbs 50 of the prongs 30 will easily engage the thickness T in self-retention, even when simply introduced in mere manual tool-less insertion. This means that any configuration of the substrate 10, woven, or full, or otherwise, accommodates an operation including insertion into the substrate and retrieval thereout of fasteners 20, in association with the substrate upper surface 14 and/or with the substrate bottom surface 16. A fastener 20 may be inserted into the substrate in any desired orientation. The insertion operation may be performed in situ, thus in the field or in factory, irrelevantly of a fastener's disposition and of a fastener's orientation, as well as by a manual process, and by an automatic process, or by a combined manual and automatic process.

The description presented hereinabove provides details about methods, systems, and devices used to implement effective vehicle arrest barriers B. In general, a substrate 10 is selected first, and then a plurality of fasteners 20 may be inserted therein even just before use. Preferably, at least two staggered rows of fasteners are embedded in the leading edge portion LEP of the woven structure 60 or of the full mat structure 62. Thereafter, the substrate 10 is disposed on the ground G in proper orientation to receive an incoming vehicle.

When an incoming vehicle is driven over the substrate 10 that is loaded with fasteners 20, two main phases of operation occur. In the first phase, the fasteners 20 will engage in self-retention into the tires of parallel wheels 18, and the substrate 10 will start to stretch longitudinally. The longitudinal stretch is needed to prevent the application of excessive shear forces on the fasteners 20, to avoid the extraction of the prongs 30 out of the wheels 18 before the substrate 10 has sufficiently, thus at least partially wrapped around the wheels 18. In the second phase, after the substrate 10 has wrapped over say half the periphery of the wheels 18, the longitudinal tension forces exerted thereon by the entanglement of the substrate 10 with the undercarriage of the vehicle will bring the wheels 18, and thus also the vehicle to a stop.

The substrate 10, or the mat M, may be configured for being stowed away, or stored as desired, in various storage dispositions, such as for example, when folded, unfolded, rolled-up, or unrolled. It is noted that when protruding away of the top surface 14, the fasteners 20 and the substrate 10 may be configured to permit rapid substrate deployment free of and without causing entanglement with the substrate when this last one is unfolded or unrolled.

In the field, the mat M may be unrolled and fasteners 20 may be added or retrieved as desired. Then the mat M may be appropriately disposed on the ground G to intercept and arrest an incoming vehicle.

It will be appreciated by persons skilled in the art, that the present invention is not limited to what has been particularly shown and described hereinabove. For example, the fasteners 20 may be attached to the substrate by different means, such as being molded, glued, potted directly onto, or retained otherwise to the substrate 10. Furthermore, a prong 30 may possibly be curved along its length and or twisted to provide better retention. Rather, the scope of the present invention is defined by the appended claims and includes both combinations and subcombinations of the various features described hereinabove as well as variations and modifications thereof which would occur to persons skilled in the art upon reading the foregoing description.

I claim:

1. A method for implementing a barrier for arresting a vehicle driven in an incoming direction (V) and having wheels (18) with tires, the method comprising the steps of:

providing a flexible, pliable, and ground-conformable woven substrate having a substrate length (L) and a substrate width (W), fastening a plurality of fasteners to the substrate, configuring the substrate as a meshed web woven in three-dimensions as a spatial structure having a substrate thickness (T) forming a substrate interior (12) with a substrate height separating a substrate top surface (14) from a substrate bottom surface (16) which is disposed on the ground (G), configuring each fastener out of the plurality of fasteners with a plurality of prongs, and configuring each fastener for reversible manual tool-less insertion into the substrate interior via the substrate bottom surface or the substrate top surface, whereby a wheel driven onto the substrate and over at least one fastener fixedly couples the substrate in retention to the wheel.

2. The method according to claim 1, wherein:

the substrate is resilient in stretch and the substrate thickness is resilient in compression.

3. The method according to claim 1, wherein:

the substrate is a flexible and pliable three-dimensional weave made of a plurality of interwoven loops of fiber connecting the top surface to the bottom surface, wherein the fibers are selected alone and in combination out of the group consisting of at least one type of single fibers, multiple fibers, natural material, and synthetic material.

4. The method according to claim 1, wherein:

the substrate interior into which the plurality of fasteners is inserted secures each fastener to the substrate and stabilizes each fastener and the plurality of prongs in orientation.

5. The method according to claim 1, wherein:

the substrate has a substrate density, and each one of the substrate thickness and the substrate density is selected alone and in combination from the group consisting of a constant density, a constant thickness, a variable density and a variable thickness.

6. The method according to claim 1, wherein:

the substrate accommodates insertion therein and retrieval thereout of the plurality fasteners by a process selected alone and in combination from the group consisting of a manual process operated in situ, a semi-automatic process, and an automatic process.

7. The method according to claim 1, wherein:

each fastener (20) out of the plurality of fasteners has a base and is configured as a fastener designated as 20[i, j] having i prongs, and j hooks, with i being a positive integer different from zero, and where j is a positive integer including zero.

8. The method according to claim 1, wherein:

at least one prong out of the plurality of prongs has a barb configured for secure self-retention to an item selected alone and in combination from the group consisting of a wheel and the substrate.

9. The method according to claim 1, wherein:

each prong out of the plurality of prongs of a fastener has a prong length selected alone and in combination from the group consisting of a same prong length and a different prong length.

10. The method according to claim 1, wherein:

each prong out of the plurality of prongs of a fastener has a prong length, and the prong length is selected alone and in combination from the group consisting of prongs hidden in an interior (12)

of the thickness (T) of the substrate (10) and prongs protruding out and away from the top surface (14).

11. The method according to claim 1, wherein:

each fastener out of the plurality of fasteners is configured as a multidirectional fastener or as a unidirectional fastener.

12. A method for implementing a barrier for arresting a vehicle driven in an incoming direction and having wheels with tires, the method comprising the steps of:

providing a flexible, pliable, and ground-conformable woven substrate having a substrate length (L) and a substrate width (W), fastening a plurality of fasteners to the substrate, configuring the substrate as a meshed web woven in three-dimensions as a spatial structure having a substrate thickness (T) forming a substrate interior (12) with a substrate height separating a substrate top surface (14) from a substrate bottom surface (16) which is disposed on the ground (G), configuring each fastener out of the plurality of fasteners as a single unitary-piece fastener implemented out of a flat-shaped blank of material forming a base and at least one prong, the at least one prong having at least one barb for retention to the substrate or to the wheel, and configuring each fastener for reversible manual tool-less insertion into the substrate interior via the substrate bottom surface or the substrate top surface, whereby a wheel driven onto the substrate and over at least one fastener fixedly couples the substrate in retention to the wheel.

13. A system for forcefully arresting a vehicle driven in an incoming direction (V) and refusing to stop, the vehicle having wheels (18) with tires, and the system comprising:

a flexible, pliable, and ground-conformable woven substrate having a substrate length (L) and a substrate width (W); and a plurality of fasteners coupled to the substrate, wherein the substrate is woven into a three-dimensional meshed web of loops configured as a spatial structure having a substrate thickness (T) forming a substrate interior (12) having a substrate height separating a substrate top surface (14) from a substrate bottom surface (16) which is disposed on the ground (G), wherein each fastener out of the plurality of fasteners is implemented out of a flat-shaped blank of material to form a base and at least one prong, and wherein each fastener is configured for reversible manual tool-less insertion into the substrate interior via the substrate bottom surface or the substrate top surface, whereby a wheel driven onto the substrate and over at least one fastener fixedly couples the substrate in retention to the wheel.

14. The system according to claim 13, wherein:

each at least one prong is inclined and disposed upstream relative to the base which is disposed downstream, and the base is configured as a symmetric or an asymmetric base.

15. The system according to claim 13, wherein:

each at least one prong has at least one barb selected alone and in combination from the group consisting of a barb for retention to a wheel and a barb for retention to the substrate.

16. The system according to claim 13, wherein:

a fastener out of the plurality of fasteners has at least one hook for retention to the substrate.

17. The system according to claim 13, wherein:

each fastener has a plurality of prongs, and the plurality of prongs are disposed to form a mutual spatial angle relative to each other, whereby fastener retention to a wheel is enhanced.

18. The system according to claim 13, wherein:

the base has a footprint that is enlarged by an addition selected alone and in combination from the group consisting of an arm and a tongue.

19. The system according to claim 13, wherein:

each fastener is inserted into the substrate via the substrate top surface or via the substrate bottom surface.

20. The system according to claim 13, wherein:

substrate resiliency is provided by appropriate selection of fibers for weaving the web and by appropriate configuration of the spatial structure.

* * * * *